United States Patent [19]

Ladrach

[11] Patent Number: 4,750,456

[45] Date of Patent: Jun. 14, 1988

[54] AUTOMATIC OIL LEVEL MAINTENANCE SYSTEM

[76] Inventor: Paul E. Ladrach, 208 Grant St., Dover, Ohio 44622

[21] Appl. No.: 80,486

[22] Filed: Jul. 31, 1987

[51] Int. Cl.[4] ..... F01M 1/00

[52] U.S. Cl. ..... 123/196 S; 184/103.2

[58] Field of Search ..... 123/196 S; 184/103.2, 184/103.1

[56] References Cited

U.S. PATENT DOCUMENTS

| | | | |
|---|---|---|---|
| 635,210 | 10/1899 | VanVriesland . | |
| 797,046 | 8/1905 | Casler . | |
| 1,105,894 | 8/1914 | Dunham . | |
| 1,122,607 | 12/1914 | King . | |
| 1,171,223 | 2/1916 | Martini . | |
| 1,194,453 | 8/1916 | Wilburn et al. . | |
| 1,317,961 | 10/1919 | Conwell . | |
| 1,465,167 | 8/1923 | Miller . | |
| 1,705,845 | 3/1929 | Woodman . | |
| 2,564,230 | 8/1951 | Pitney | 137/68 |
| 2,615,442 | 10/1952 | Berry | 123/196 |
| 2,886,056 | 5/1959 | Ratliff | 184/103.2 |
| 2,946,405 | 7/1960 | Zachrisson | 184/103 |
| 3,712,420 | 1/1973 | Pelizzoni | 184/103 |
| 3,777,852 | 12/1973 | Samalon | 184/103 |
| 4,091,894 | 5/1978 | Lang | 184/103 |
| 4,091,895 | 5/1978 | Lang | 184/103 |
| 4,108,201 | 8/1978 | Lang | 137/393 |
| 4,564,500 | 1/1986 | Keady | 184/103.1 |
| 4,589,524 | 5/1986 | Laycock | 184/103.1 |
| 4,603,666 | 8/1986 | Martinelli | 123/196 |

*Primary Examiner*—E. Rollins Cross

*Attorney, Agent, or Firm*—Michael Sand Co.

[57] ABSTRACT

An automatic oil level maintenance system for an internal combustion engine of the type having a crankcase containing a supply of oil and a vacuum source when the engine is running. An airtight oil reservoir contains a supply of make up oil and a vacuum actuated pump has a spring-biased flexible diaphragm therein. The crankcase, oil reservoir, pump, and vacuum are operatively connected by conduits, with the source of vacuum usually the carburetor of the engine. The pump maintains the oil in the crankcase at predetermined engine run and stop levels. The vacuum is applied to the diaphragm when the engine is running and any excess make up oil is withdrawn from the crankcase with the resulting oil level therein falling to an engine run level. The vacuum is removed from the diaphragm when the engine is stopped and make up oil is forced into the crankcase by movement of the spring-biased diaphragm with the resulting oil level in the crankcase rising to engine stop level. If oil is used by the engine during a run cycle, the system will add oil to the crankcase to maintain the level therein at the predetermined levels after one or more starts and stops of the engine.

19 Claims, 2 Drawing Sheets

AUTOMATIC OIL LEVEL MAINTENANCE SYSTEM

TECHNICAL FIELD

The invention relates to an automatic oil level maintenance system and in particular to an oil level maintenance system for an internal combustion engine. More particularly, the invention relates to a maintenance system in which a pump connected to a vacuum source and an airtight oil reservoir containing a supply of make up oil cooperate to maintain the oil supply in the crankcase of the engine at a predetermined level.

BACKGROUND ART

One of the most important yet frequently neglected items in an internal combustion engine of the type having a crankcase containing a supply of oil is the maintenance of that oil supply at a proper level. This phenomenon is particularly evident in automobiles and trucks, but is also observable in other devices such as lawn mowers and motorcycles.

Periodic checking of the lubricating oil level in the engine crankcase to prevent it from falling below a predetermined level is important because forgetting to make such checks can lead to serious damage to the engine if the oil level drops below the predetermined level. At present, this checking relies on the engine user who must periodically check the level of oil and, if necessary, replenish it to its proper level. Such checking in most engines is accomplished by manual checking of the crankcase dipstick. However, in many engines the dipstick is either hard to locate or, once located, is positioned in the engine so that it requires the engine user to soil his or her hands and/or clothes on adjacent engine components while gaining access to the dipstick. Furthermore, in order to obtain an accurate reading of the level of oil present in the engine at a given time, after its location the dipstick must be withdrawn from the crankcase, wiped free of excess oil, reinserted, withdrawn again, and read. These inconveniences cause many engine users to neglect checking, either purposely or inadvertently, the oil level in their engines. Forgetting to make such oil level checks can lead to serious damage to the engine necessitating costly repairs or replacement and aggravation to the owner of the vehicle engine.

As mentioned above, this problem is most evident in automobiles and trucks, with the increasing scarcity of full-service gas stations and the advent of the self-serve station exacerbating the problem.

Numerous devices for automatically maintaining the oil level in the crankcase of an internal combustion engine are shown in the known prior art. However, these known devices all have at least one and in some cases many of the disadvantages listed below, which are believed to be eliminated by my invention. These disadvantages include lacking means for compensating for overfilling of the engine crankcase when the crankcase is in an unlevel position, requiring costly valves which are subject to mechanical failure for operation of the system or to allow the make up oil reservoir to be filled with oil, not providing means for visually checking the oil level without manipulation of a dipstick, not automatically maintaining the engine oil level, not providing means for refilling the make up reservoir without the oil running into the crankcase, requiring expensive electronic devices which are subject to failure for alerting the operator to low levels of oil in the crankcase, requiring heating of the make up reservoir by the engine for proper operation of the system, and requiring alteration of the engine crankcase for installation of the system. Some examples of known prior art oil level maintenance systems are shown in U.S. Pat. Nos. 635,210; 797,046; 1,105,894; 1,122,607; 1,171,223; 1,194,453; 1,317,961; 1,465,167; 1,705,845; 2,564,230; 2,615,442; 2,946,405; 3,712,420; 3,777,852; 4,091,894; 4,091,895; 4,108,201; and 4,603,666.

There is no automatic oil level maintenance system for an internal combustion engine of which I am aware which maintains the oil level in the crankcase of an engine without utilizing expensive components, which indicates the level of oil therein by visual inspection of the make up oil reservoir, and which is quickly and easily installed.

DISCLOSURE OF THE INVENTION

Objectives of the invention include providing an automatic oil level maintenance system for an internal combustion engine which is economical to manufacture and is easily integrated into an existing engine without requiring expensive and time-consuming modifications thereto.

Another objective of the invention is to provide an automatic oil level maintenance system which operates automatically with the normal starting and stopping of the engine by the operator thereof, and in which the level of make up oil in the make up reservoir is visually observed obviating the use of messy and inconvenient dipsticks to ascertain the amount of oil in the crankcase of the engine.

A still further objective of the invention is to provide an automatic oil level maintenance system in which replenishment of the make up oil in the make up reservoir can be accomplished quickly and easily without the use of special valves for shutting off the flow of make up oil to the crankcase.

Still another objective of the invention is to provide an automatic oil level maintenance system which has no valves which may clog and/or wear out, oil or air pinholes which may clog, electrical components or circuits which may malfunction, or moving parts other than a flexing diaphragm which are subject to wear, thereby reducing significantly the possibility that repair and/or replacement of system components will be required.

A further objective of the invention is to provide an automatic oil level maintenance system in which the make up oil in the make up reservoir is prevented from draining into the crankcase or carburetor of the engine if an air leak occurs in the system.

Another objective of the invention is to provide an automatic oil level maintenance system in which an unlevel engine will not cause excessive amounts of oil from the make up reservoir to flow into, and remain in, the crankcase of the engine.

Still another objective of the invention is to provide an automatic oil level maintenance system in which air bubbles in the system are eliminated, and in which extremely cold weather will not interfere with the operation of the system.

These objectives and advantages of the invention are obtained by the automatic oil level maintenance system for an internal combustion engine of the type having a crankcase containing a supply of oil and a source of vacuum when the engine is running, the general nature of which may be stated as including, an airtight oil reservoir containing a supply of make up oil and having an air trap mounted therein; a first conduit having first and second ends, operatively connected between the crankcase oil supply and the oil reservoir, respectively, said first end terminating at a first predetermined oil level in the crankcase when the engine is running, and said second end terminating within the air trap; and a vacuum actuated pump having a diaphragm, operatively connected to the oil reservoir and to the vacuum source for maintaining the oil supply in the crankcase at the first predetermined oil level, said diaphragm withdrawing any excess make up oil from the crankcase into the oil reservoir when the vacuum source is applied to the diaphragm when the engine is running, and said diaphragm forcing make up oil contained in said pump into the oil reservoir and oil from the oil reservoir into the crankcase oil supply thereby raising the level of said supply to a second predetermined level when the vacuum is removed from the diaphragm when the engine is stopped.

BRIEF DESCRIPTION OF THE DRAWINGS

A preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

BEST MODE FOR CARRYING OUT THE INVENTION

Figure 1:
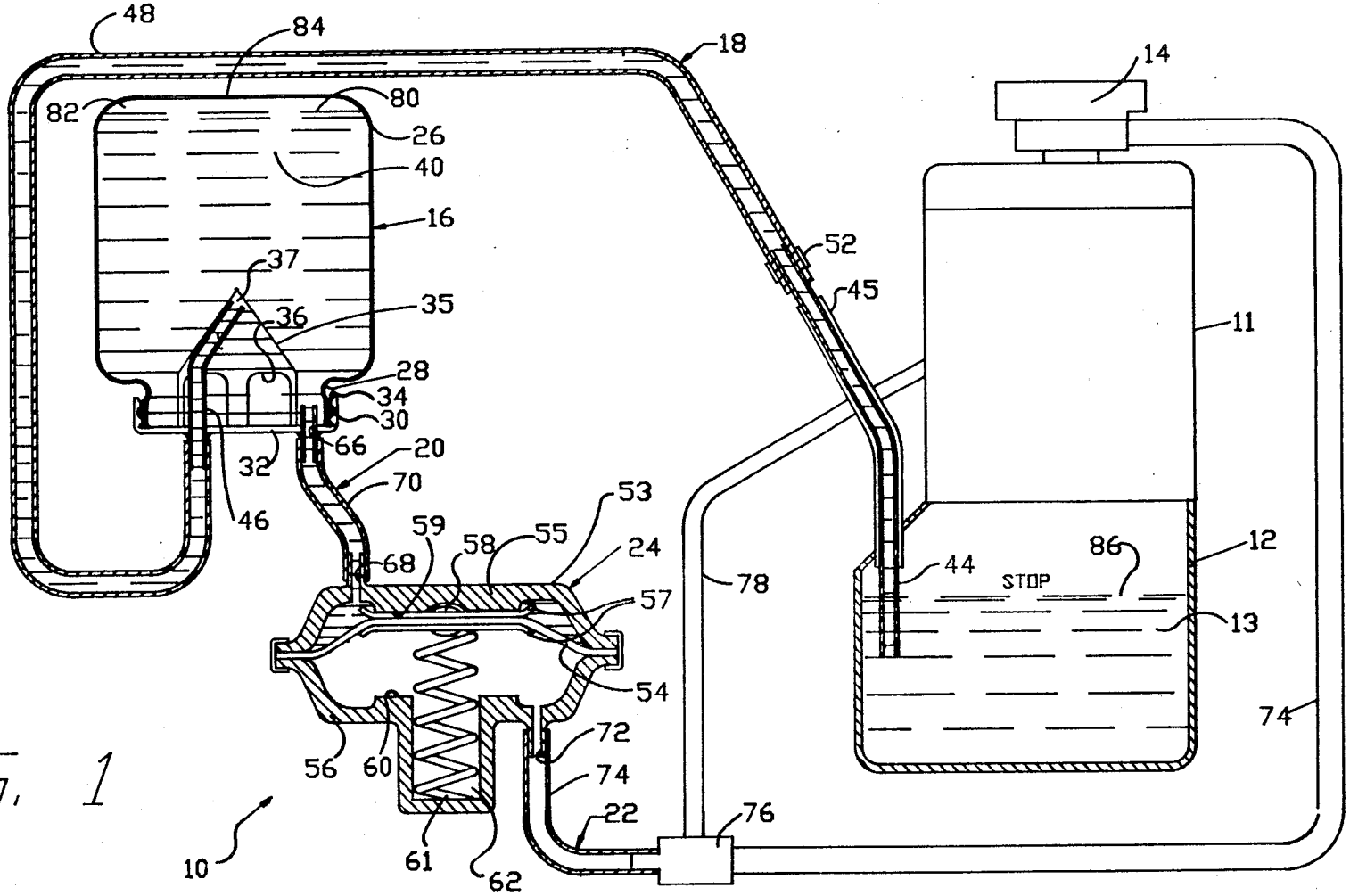
FIG. 1 is a diagrammatic view of the automatic oil level maintenance system of the invention with portions in section, showing the position of the pump diaphragm and the levels and location of oil in the system when the engine is stopped.
Figure 2:
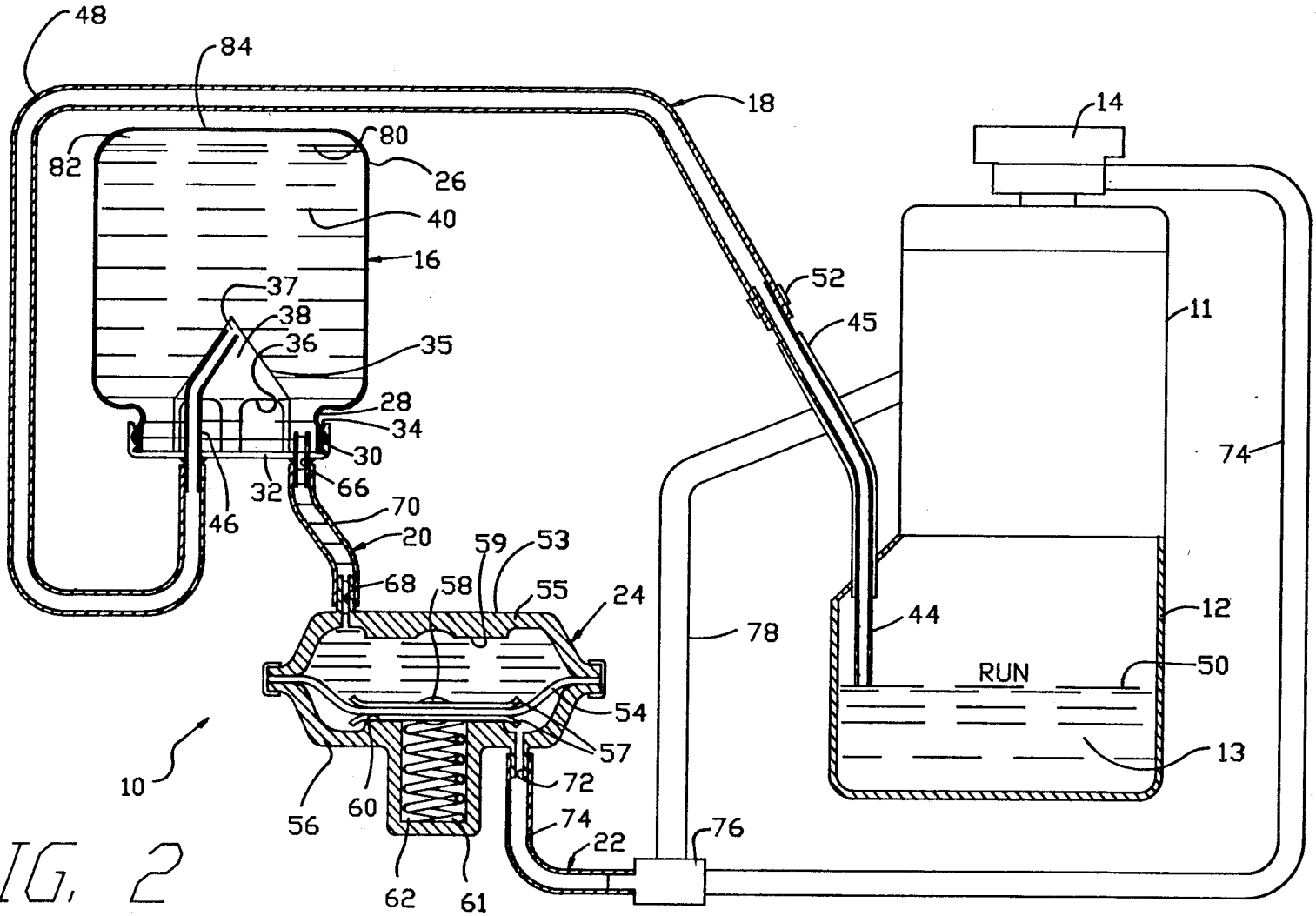
FIG. 2 is a diagrammatic view of the system similar to FIG. 1, showing the position of the pump diaphragm and the levels and location of oil in the system when the engine is running.

The automatic oil level maintenance system of the invention which is adapted for use with an internal combustion engine is indicated generally at 10, and is shown in detail in FIGS. 1 and 2. The system is shown in its intended use, operativley connected to two components of a usual internal combustion engine 11, the components being a crankcase 12 containing a usual supply of oil 13 and a carburetor 14 which generates a source of vacuum when the engine is running. The system includes an airtight make up oil reservoir, indicated generally at 16, first, second and third conduits, indicated generally at 18, 20 and 22, respectively, and a vacuum actuated pump, indicated generally at 24.

Oil reservoir 16 includes an inverted generally jar-shaped container 26 having a widemouthed neck 28, provided with a screw-threaded outside surface 30, and preferably is formed of a translucent, rigid, unbreakable plastic having a capacity of between one and two quarts. A usual one to two quart mason jar (not shown), preferably having a plastic coating or the like on its outer surface to prevent breakage of the jar, has also been found to function well as container 26. A cap 32, preferably of the type used to provide a closure for a usual mason jar, has a screw threaded inside surface 34 for threadably engaging the widemouthed neck and provides an airtight seal for the make up oil reservoir.

An air trap 35 having an inverted generally cone shaped hollow structure, and having an open lower base 36 and a closed upper vertex 37, is mounted within oil reservoir 16 adjacent cap 32 for trapping air 38 (FIG. 2) in the air trap when engine 11 is running. The air trap may be mounted on cap 32 or, in the alternative, may be formed integrally with container 26 (not shown). The manner in which the air trap is mounted within the oil reservoir allows air 38 to be trapped within the air trap during operation of system 10, whereby the air trap functions as a barometric jar. The reservoir also contains a supply of make up oil 40.

First conduit 18 operatively connects crankcase oil supply 13 and the hollow interior of air trap 35 of oil reservoir 16. The first conduit has first and second ends 44 and 46, respectively, and a middle section 48 preferably formed of plastic and having a minimum inside diameter of one-quarter inch. First end 44 preferably is a tube formed of nylon or metal which is shaped or is shapeable for insertion into a dipstick tube 45 of crankcase 12, and which terminates at a first predetermined oil level 50 in the crankcase when the engine is running (FIG. 2). Second end 46 is a rigid tube which extends through cap 32 into oil reservoir 16 and air trap 35 and which preferably is integral with or welded to cap 32 for maintaining the airtight seal of the reservoir. The second end terminates within air trap 35 adjacent vertex 37. The top portion of second end 46 may function to support air trap 35 within the oil reservoir (not shown) as an alternative to mounting the air trap on cap 32 or forming the air trap integrally with container 26. First and second ends of the first conduit have a minimum outside diameter of one-quarter inch and the middle section has a minimum inside diameter of one-quarter inch, whereby the first and second ends are force-fitted into the ends of the middle section to form first conduit 18. First end 44 is further secured to middle section 48 by spring clamp 52. Further, these diameters have been found to be optimum for proper movement of the oil through the first conduit.

Vacuum actuated pump 24 has a hollow housing 53 formed of aluminum, steel or other suitable material, and has a capacity greater than the combined capacity of air trap 35 and first conduit 18, the significance of which will be described in greater detail below. A flexible diaphragm 54 is clampingly secured by its outer edges between upper and lower halves 55 and 56, respectively, of housing 53. A pair of plates 57 are secured to the top and bottom surfaces of diaphragm 54 by fastener 58. The plates function to add support to the diaphragm and to protect it from continual direct contact with the upper and lower interior surfaces 59 and 60, respectively, of housing 53 and a spring 61 during operation of pump 24. Spring 61 is positioned in compartment 62 of housing 53 and functions to bias diaphragm 54 in the direction of reservoir 16.

Second conduit 20 operatively connects make up reservoir 16 and pump 24. The second conduit has first and second ends 66 and 68, respectively, and a middle section 70 preferably formed of plastic. First end 66 is a rigid tube which extends through cap 32 into oil reservoir 16, and which preferably is integral with or welded to cap 32 for maintaining the airtight seal of the reservoir. Second end 68 is an upward tubular extension of upper half 55 of housing 53. The first and second ends of the second conduit have an outside diameter equal to the inside diameter of the middle section whereby the first and second ends are force fitted into the ends of the middle section to form second conduit 20.

Third conduit 22 operatively connects pump 24 and carburetor 14, which provides the vacuum source for the improved maintenance system. The third conduit has a first end 72, a second end (not shown), and a middle section 74 preferably formed of plastic. First end 72 is a downward tubular extension of lower half 56 of housing 53. The first end of the third conduit has an outside diameter equal to the inside diameter of the middle section whereby the first end is force-fitted into one end of the middle section, the other end of the middle section being connected to the second end of the third conduit in a similar manner, with the second end being an outward tubular extension or the like from carburetor 14. Furthermore, a T-shaped connector 76 is inserted in middle section 74 of third conduit 22 and leads to the power brake system (not shown) of the automobile by a conduit 78.

Oil reservoir 16 is filled with a supply of make up oil 40 by inverting the reservoir from its operational position, removing cap 32, filling the reservoir with oil to a point adjacent neck 28, replacing the cap, and positioning the reservoir adjacent engine 11 as shown in FIGS. 1 and 2. After positioning the reservoir, the supply of make up oil therein should approximate a level 80 with an air space 82 remaining between level 80 and a top wall 84 of the reservoir.

The following description of the system's operation is described in conjunction with an internal combustion engine of an automobile. However, it is understood that the system may be used in conjunction with other types of equipment utilizing internal combustion engines, such as trucks, motorcycles and lawnmowers.

To illustrate the operation of the system, assume that engine 11 is running and system 10 is in equilibrium with oil reservoir 16 filled with make up oil 40 up to level 80 and air trap 35 and first conduit 18 filled with air (FIG. 2). A vacuum is applied by carburetor 14 through conduit 22 to flexible diaphragm 54 of pump 24 and pulls the diaphragm to its downwardmost position against lower wall 60 of housing 53. When the diaphragm is in the downwardmost position, second conduit 20 and housing 53 are filled with make up oil. Further assume that the housing of the pump has a volume capacity of four cubic inches when the diaphragm is in its downwardmost position, the air trap a capacity of two cubic inches and the first conduit a capacity of one cubic inch. The level of oil in the crankcase is at first predetermined level 50 when the engine is running.

The engine then is stopped, and the vacuum is removed from the diaphragm, whereby spring 61 urges diaphragm 54 upwardly toward its biased position against upper wall 59 of housing 53, thereby forcing the four cubic inches of oil contained therein into oil reservoir 16 (FIG. 1). Air space 82 is compressed by the entrance of the four cubic inches of oil into the reservoir so that a corresponding amount of oil is displaced into the air trap, with trapped air 38 therein offering less resistance to the movement of the oil than does air space 82. Air 38 within air trap 35 then is forced into first conduit 18, the cone shape of the air trap assisting in this movement. A total of three cubic inches of air is expelled from the air trap and the first conduit combined and into crankcase 12. One cubic inch of oil follows the air into the crankcase to raise the level of oil therein from level 50 to level 86 which represents a second predetermined level of crankcase oil, or the stop level. The air trap and first conduit are filled with make up oil at this stage of operation of the system.

The engine then is started, the vacuum builds, and the flexible diaphragm is pulled to lower wall 60 of pump housing 53 as shown in FIG. 2. The pump 24 will withdraw one cubic inch of excess make up oil from the crankcase thereby lowering the level of oil therein to run level 50, and then will withdraw an additional three cubic inches of air thereby refilling the first conduit and the air trap with air and causing the one cubic inch of oil to return to the oil reservoir. At this stage of operation of the system, the pump is again filled with oil. The system is in a state of equilibrium and the engine oil level is maintained at the desired run level.

Further assume that while engine 11 was running it burned one half cubic inch of oil. Upon stopping the engine, three cubic inches of air and one cubic inch of oil will be forced into the crankcase by pump 24 as long as an adequate supply of make up oil is maintained in oil reservoir 16. However, upon starting the engine, only one half cubic inch of oil and three and one half cubic inches of air is withdrawn from the crankcase thereby causing the first conduit and the air trap to be filled with air, and further causing the excess one-half cubic inch of air to bubble into the oil reservoir along with one-half cubic inch of oil, as opposed to only the usual one cubic inch of oil when the system is in equilibrium as described above, thereby lowering the level of oil in the oil reservoir from level 80 down to one-half cubic inch therebelow. At the next engine stoppage, three cubic inches of air and one cubic inch of oil again will be forced into the crankcase to raise the oil level therein to level 86. If the engine burns large amounts of oil while the engine is running, it will take several stops and starts of the engine before levels 50 and 86 are maintained at each engine start and stop, respectively. Furthermore, it will become evident to the engine user upon visual inspection of the oil reservoir that the engine is burning oil so that he or she may add an appropriate amount of make up oil to the oil reservoir to return the make up oil to level 80. This should preferably be done before the level of oil in the reservoir drops to a level adjacent air trap 35 to insure that sufficient make up oil 40 is present in the oil reservoir to supply crankcase 12 with oil if the oil level therein falls below the predetermined levels.

The design of this system overcomes a chief problem found in several of the prior art systems, that of an unlevel engine causing the conduit between the oil reservoir and crankcase to be in communication with air instead of oil when the engine is running because the crankcase tilts with the automobile, or other vehicle, as it moves up or down an incline. In some prior systems, such a false low crankcase oil reading would cause the oil reservoir to allow oil to gravitate into the crankcase because of the introduction of atmospheric pressure into the reservoir. When the vehicle reaches a level state, the crankcase oil level will be excessively high with no means for returning the excess oil to the oil reservoir, and possibly leaving the engine user, upon viewing the oil level in the make up reservoir, with the mistaken belief that the engine has burned more oil than is actually the case. My system, however, compensates for an unlevel engine because the same amount of oil is added to the crankcase each time the engine is stopped whether the engine is level or not. If the engine is unlevel when it is started and an excessively large amount of air or oil is withdrawn from the crankcase, several starts and stops of the engine will adjust the amount of oil therein to the appropriate predetermined levels since the pump is capable of displacing variable amounts of oil from the crankcase when the engine is started.

Furthermore, the design of the automatic oil level maintenance system of the invention prevents drainage of the make up oil in the oil reservoir into either the crankcase or the carburetor of the engine. The make up oil will not drain into the crankcase because of the loop placed in the first conduit thereby preventing gravity from pulling the make up oil from the reservoir downwardly into the crankcase if an air leak occurs in the system. Also, the flexible diaphragm, in addition to its pumping purpose, functions as a seal to prevent drainage of make up oil from the oil reservoir, second conduit and pump into the third conduit and carburetor of the engine.

Additionally, extremely cold weather will not interfere with the operation of the system even though oil does not flow as readily in cold temperatures. Since make up oil is added to the crankcase only when the engine is stopped, the make up oil will have been warmed by the running engine thereby causing it to flow easily into the crankcase. However, when a cold engine is started, it may take several minutes for the oil to warm to a temperature whereby it will flow easily enough to be withdrawn from the crankcase by the pump thereby lowering the oil level in the crankcase to the run level, but it will eventually be withdrawn after several minutes.

Furthermore, it being understood that this invention is not limited to the precise embodiment herein disclosed, the following changes may be made within the scope of what is claimed, without departing from the spirit of the invention.

It is possible for second end 46 of first conduit 18 to enter top wall 84 or the sidewall of the oil reservoir without effecting the operation of the system.

Cap 32 may be eliminated from the oil reservoir to ensure its airtight integrity. Thus, in order to fill the oil reservoir with make up oil excess oil would have to be added to the crankcase through the usual crankcase oil fill. The reservoir would then be inverted and third conduit 22, which leads to the vacuum source, would be connected to first end 66 of second conduit 20. The make up oil supply would thereby be replenished from the excess crankcase oil supply through first conduit 18 by the application of the vacuum thereto. In the alternative, the oil reservoir could be mounted on a diagonal axis in the engine compartment wherein first end 66 would be oriented downward diagonally when the system is operating, and would be pivotally rotated to an upward diagonal orientation for manual filling of oil into the reservoir through first end 66.

Further, a pressure or vacuum switch could be connected to second conduit 20 whereby a dash light or a car door buzzer or the like could be activated when the system is used in an automobile and is operating properly.

Additionally, dipstick tube 45, during manufacture of an automobile or other device having a dipstick tube, could be extended downwardly into the crankcase to oil level 50 thereby obviating the need for first end 44 of first conduit 18. Middle section 48 of the first conduit could then be directly clamped to the upper end of the dipstick tube. The minimum inside diameter of dipstick tube 45 would preferaby be three-eighths of an inch thereby allowing a larger volume of oil to flow and consequently increasing the rapidity of the fill and withdrawal cycles of the system. During long continuous runs of the engine, a switch on the dash of the automobile could control an electric valve (not shown) connected to middle section 74 of third conduit 22. This valve would cause the vacuum to be removed from the diaphragm while the engine is running so that the oil level in the crankcase could be maintained at the proper level without stopping the automobile if the engine is burning oil while the engine is running. The switch could then be deactivated thereby allowing the vacuum to again operate on the diaphragm. This switch could be controlled by a timer so that the oil could be checked at regular intervals during a long trip, such as every hour.

Finally, the pump alternatively could be actuated by an electrical motor connected to the electrical system of a vehicle in which maintenance system 10 is used.

Accordingly, the improved automatic oil level maintenance system is simplified, provides an effective, safe, inexpensive, and efficient system which achieves all the enumerated objectives, provides for eliminating difficulties encountered with prior systems, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved automatic oil level maintenance system is constructed and used, the characteristics of the improved system, and the advantageous, new and useful results obtained; the new and useful structures, devices, elements, arrangements, parts, and combinations, are set forth in the appended claims.

What is claimed is:

1. An automatic oil level maintenance system for an internal combustion engine of the type having a crankcase containing a supply of oil and a source of vacuum when the engine is running, said system including:

(a) an airtight oil reservoir containing a supply of make up oil and having an air trap mounted therein;

(b) a first conduit having first and second ends, operatively connected between the crankcase oil supply and the oil reservoir, respectively, said first end terminating at a first predetermined oil level in the crankcase when the engine is running, and said second end terminating within the air trap; and (c) a vacuum actuated pump having a diaphragm, operatively connected to the oil reservoir and to the vacuum source for maintaining the oil supply in the crankcase at the first predetermined oil level, said diaphragm withdrawing any excess make up oil from the crankcase into the oil reservoir when the vacuum source is applied to the diaphragm when the engine is running, and said diaphragm forcing make up oil contained in said pump into the oil reservoir and oil from the oil reservoir into the crankcase oil supply thereby raising the level of said supply to a second predetermined level when the vacuum is removed from the diaphragm when the engine is stopped.

2. The system defined in claim 1 in which the vacuum source is provided by the carburetor of the internal combustion engine.

3. The system defined in claim 1 in which the oil reservoir is formed of rigid, translucent plastic and has a capacity of between one and two quarts.

4. The system defined in claim 1 in which the oil reservoir includes an inverted generally jar-shaped container having a neck provided with a screw-threaded outside surface.

5. The system defined in claim 4 in which the oil reservoir includes a cap having a screw-threaded inside surface for threadably engaging the container neck to provide for an airtight seal on said oil reservoir.

6. The system defined in claim 4 in which the air trap is an inverted, generally cone-shaped hollow structure, having an open lower base and a closed upper vertex.

7. The system defined in claim 6 in which the air trap is mounted within and adjacent the neck of the jar-shaped container of the oil reservoir for trapping air within said air trap when said oil reservoir contains a supply of make up oil.

8. The system defined in claim 1 in which the first conduit includes a middle section formed of plastic and having an inside diameter of approximately one-quarter inch for operatively connecting the first and second ends thereof.

9. The system defined in claim 8 in which the first end of the first conduit is a tube formed of nylon which has an outside diameter of approximately one quarter inch for insertion into the crankcase.

10. The system defined in claim 8 in which the first end of the first conduit is a tube formed of metal which has an outside diameter of approximately one-quarter inch for insertion into the crankcase.

11. The system defined in claim 8 in which the second end of the first conduit is a rigid tube which extends into the oil reservoir maintaining the airtight seal of said reservoir.

12. The system defined in claim 1 in which the vacuum actuated pump includes a hollow housing having a volume capacity greater than the combined volume capacity of the air trap and the first conduit.

13. The system defined in claim 12 in which the diaphragm of the pump is spring biased toward the oil reservoir for forcing oil out of said pump and into said oil reservoir and oil from the oil reservoir into the crankcase when the vacuum is removed from said diaphragm when the engine is stopped.

14. The system defined in claim 1 in which a second conduit having first and second ends operatively connects the oil reservoir and the pump.

15. The system defined in claim 14 in which a middle section of the second conduit is formed of plastic and operatively connects the first and second ends.

16. The system defined in claim 15 in which the first end of the second conduit is a rigid tube which extends into the oil reservoir maintaining the airtight seal of said reservoir, and the second end is a tubular extension of the pump.

17. The system defined in claim 1 in which a third conduit having first and second ends operatively connects the pump and the vacuum source.

18. The system defined in claim 17 in which a middle section of the conduit is formed of plastic and operatively connects the first and second ends.

19. The system defined in claim 18 in which the first end of the third conduit is a tubular extension of the pump, and the second end is a tubular extension of the vacuum source.

* * * * *